US011506362B1

(12) United States Patent
Wang et al.

(10) Patent No.: US 11,506,362 B1
(45) Date of Patent: Nov. 22, 2022

(54) CHRISTMAS LAMP WITH LAMP CORE PULL-OUT PREVENTION STRUCTURE AND FORMING PROCESS THEREFOR

(71) Applicant: Jinqing Wang, Linhai (CN)

(72) Inventors: Jinqing Wang, Linhai (CN); Yanting Sun, Linhai (CN)

( * ) Notice: Subject to any disclaimer, the term of this patent is extended or adjusted under 35 U.S.C. 154(b) by 0 days.

(21) Appl. No.: 17/648,446

(22) Filed: Jan. 20, 2022

(51) Int. Cl.

| | |
|---|---|
| ***F21V 19/00*** | (2006.01) |
| ***F21S 4/10*** | (2016.01) |
| ***F21V 23/00*** | (2015.01) |
| ***F21V 17/10*** | (2006.01) |

(52) U.S. Cl.
CPC ..... *F21V 19/0015* (2013.01); *F21S 4/10* (2016.01); *F21V 17/10* (2013.01); *F21V 23/002* (2013.01)

(58) Field of Classification Search
CPC .... F21V 19/0015; F21V 23/002; F21V 17/10; F21S 4/10
See application file for complete search history.

(56) References Cited

U.S. PATENT DOCUMENTS

| | | | | |
|---|---|---|---|---|
| 8,070,347 | B1 * | 12/2011 | Lin | F21S 4/10 362/656 |
| 10,408,392 | B2 * | 9/2019 | Yu | F21S 4/10 |
| 10,753,595 | B1 * | 8/2020 | Wan | F21V 3/02 |
| 2015/0211727 | A1 * | 7/2015 | Loomis | F21V 31/005 362/375 |

* cited by examiner

*Primary Examiner* — Matthew J. Peerce

(57) ABSTRACT

The present invention discloses a Christmas lamp with a lamp core pull-out prevention structure and a forming process therefor. A lamp core is stably mounted so that a good pull-out prevention effect can be achieved, and the forming process is simple so that automatic production can be realized. A technical scheme consists in that the Christmas lamp includes: a lamp holder, a lamp core and a lamp shell. The lamp holder is connected to the lamp shell, and the lamp core passes through the lamp holder and is located in the lamp shell. The Christmas lamp further includes a fixing ferrule. The lamp holder is internally provided with a resilient clamping sleeve for radially clamping the lamp core, and the fixing ferrule is provided over the resilient clamping sleeve. When the lamp holder is mounted and connected to the lamp shell, the fixing ferrule is axially abutted between the lamp holder and the lamp shell, and the fixing ferrule radially locks the resilient clamping sleeve, such that the resilient clamping sleeve locks the lamp core. The present invention is applicable to the technical field of decorative lamps.

8 Claims, 3 Drawing Sheets

CHRISTMAS LAMP WITH LAMP CORE PULL-OUT PREVENTION STRUCTURE AND FORMING PROCESS THEREFOR

TECHNICAL FIELD

The present invention relates to the technical field of decorative lamps, and in particular to a Christmas lamp with a lamp core pull-out prevention structure and a forming process therefor.

BACKGROUND

Christmas lamps are holiday string lights for decoration. The existing lamp core installation structure of the Christmas lamps usually consists in that a resilient clamping sleeve is provided inside a lamp holder, and the head of the lamp core is axially retained on an end face of the resilient clamping sleeve to provide an axial detachment prevention function. However, in actual use, when the lamp core is pulled by an external force, the resilient clamping sleeve is likely to be deformed, and the lamp core is still likely to be detached from the resilient clamping sleeve, resulting in poor connection stability. Therefore, there is a need for improvements.

SUMMARY

An objective of the present invention is to provide a Christmas lamp with a lamp core pull-out prevention structure and a forming process therefor, in which a lamp core is stably mounted so that a good pull-out prevention effect can be achieved.

The objective of the present invention is achieved by a Christmas lamp with a lamp core pull-out prevention structure. The Christmas lamp includes a lamp holder, a lamp core and a lamp shell. The lamp holder is connected to the lamp shell, and the lamp core passes through the lamp holder and is located in the lamp shell. The Christmas lamp further includes:

a fixing ferrule.

The lamp holder is internally provided with a resilient, clamping sleeve for radially clamping the lamp core, and the fixing ferrule is provided over the resilient clamping sleeve.

When the lamp holder is mounted and connected to the lamp shell, the fixing ferrule is axially abutted between the lamp holder and the lamp shell, and the fixing ferrule radially locks the resilient clamping sleeve.

Further, the lamp core includes:

a luminous body provided with two lead wires led out from the luminous body;

power lines connected to the lead wires;

a core stem, wire grooves being provided in a side wall of the core stein, and connected ends of the lead wires and the power lines being embedded into the wire grooves; and a heat shrinkable tube provided over an outer wall of the core stem.

An outer diameter of the luminous body is greater than that of the core stein.

Further, the lead wires are fixed to the power lines by means of welding.

Further, the fixing ferrule includes:

a shrinkage section;

an expansion section; and a positioning ring, where the shrinkage section is located at one end of the expansion section, and the positioning ring is located at the other end of the expansion section.

Further, the positioning ring is provided with a notch.

Further, the lamp holder is in threaded connection with the lamp shell.

Further, the lamp holder is provided with a hanger.

By adopting the technical scheme described above, when the head of the lamp core passes through the lamp holder and the resilient clamping sleeve, the resilient clamping sleeve radially clamps the lamp core, and the end portion of the resilient clamping sleeve axially abuts against the head of the lamp core, so as to provide the detachment prevention function. The fixing ferrule is then mounted. After being axially abutted, the fixing ferrule will further radially clamp the resilient clamping sleeve. In this case, the end portion of the resilient clamping sleeve cannot radially expand, so the resilient clamping sleeve has good clamping stability, and the lamp holder cannot be axially pulled out, providing the detachment prevention function.

A forming process for a Christmas lamp with a lamp core pull-out prevention structure includes:

a first step of preparing a lamp holder and a lamp shell;

a second step of assembling, a lamp core; and a third step of assembling the Christmas lamp: passing the lamp core through a resilient clamping sleeve on the lamp holder, retaining an end portion of the resilient clamping sleeve at the connection between a core stem and a luminous body, then sleeving a fixing ferrule over the resilient clamping sleeve, and finally screwing the lamp shell.

In the second step, the specific sub-steps of assembling the lamp core include:

S1. fixing two lead wires of the luminous body to power lines by means of welding;

S2. mounting a core stem between the two lead wires, such that the connections between the two lead wires and the power lines are embedded into wire grooves of the core stem;

S3. sleeving a heat shrinkable tube over the core stem, the length of the heat shrinkable tube being greater than that of the core stem; and S4. blowing hot air over the heat shrinkable tube, such that the heat shrinkable tube shrinks and dads the core stem, while one end of the heat shrinkable tube partially clads the luminous body and the other end of the heat shrinkable tube partially clads the power lines.

The technical scheme has the following advantages: the whole process of the specific sub-steps S1 to S4 of assembling the lamp core has realized automatic welding and production, greatly improving the production efficiency; and the forming method is simple, and the installation stability of the formed lamp core is high, which can provide a good detachment prevention function.

Figure 1:
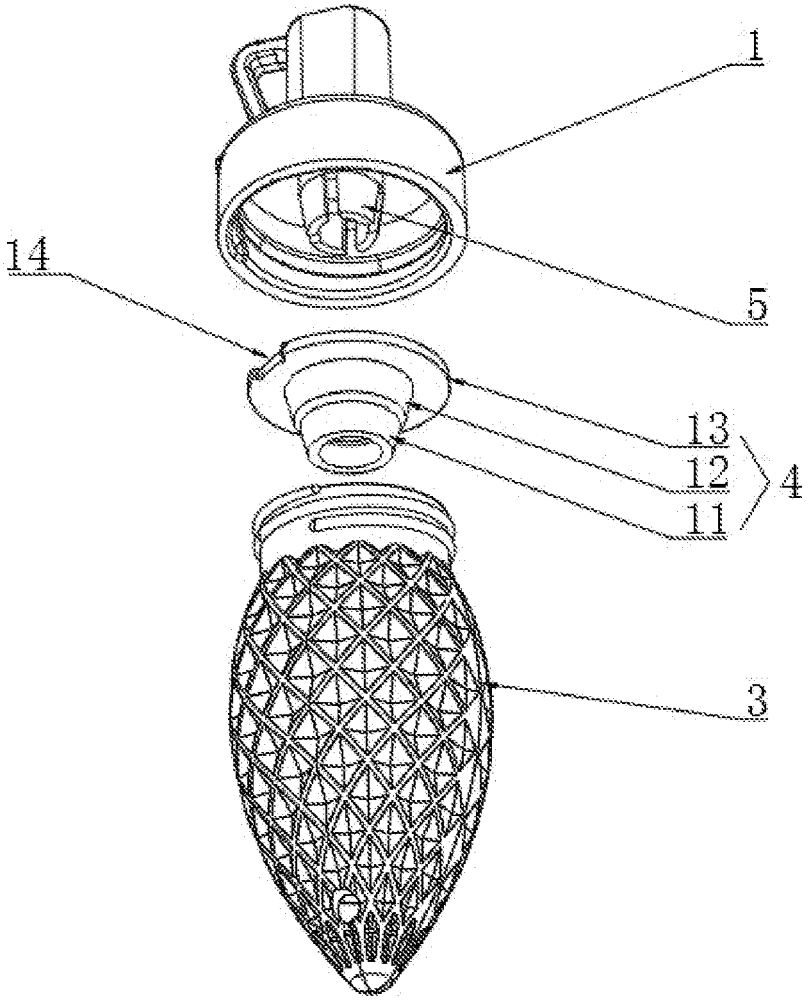
FIG. 1 is a schematic structural diagram of the present invention.

List of reference numerals: 1 Lamp holder; 2 Lamp core; 3. Lamp shell; 4. Fixing ferrule; 5. Resilient clamping sleeve; 6. Luminous body; 7. Power line; 8. Core stem; 9.

Wire groove; 10. Heat shrinkable tube; 11. Shrinkage section; 12. Expansion section; 13. Positioning ring; 14. Notch; 15. Hanger.

DETAILED DESCRIPTION

Figure 2:
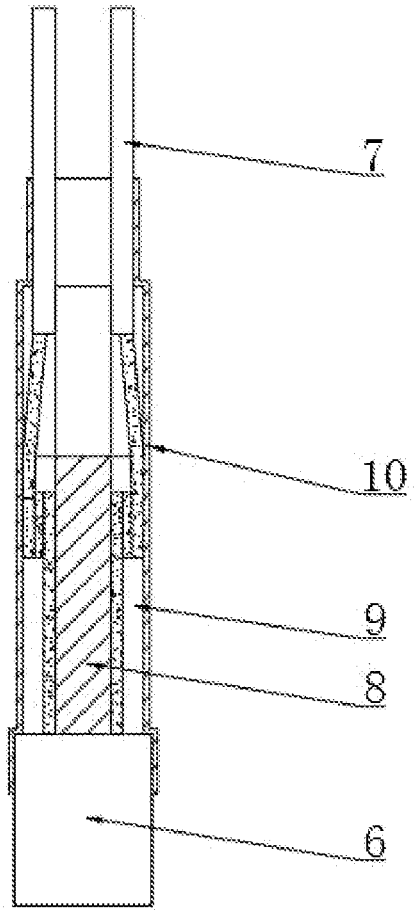
FIG. 2 is a schematic structural diagram of a lamp core of the present invention.
Figure 3:
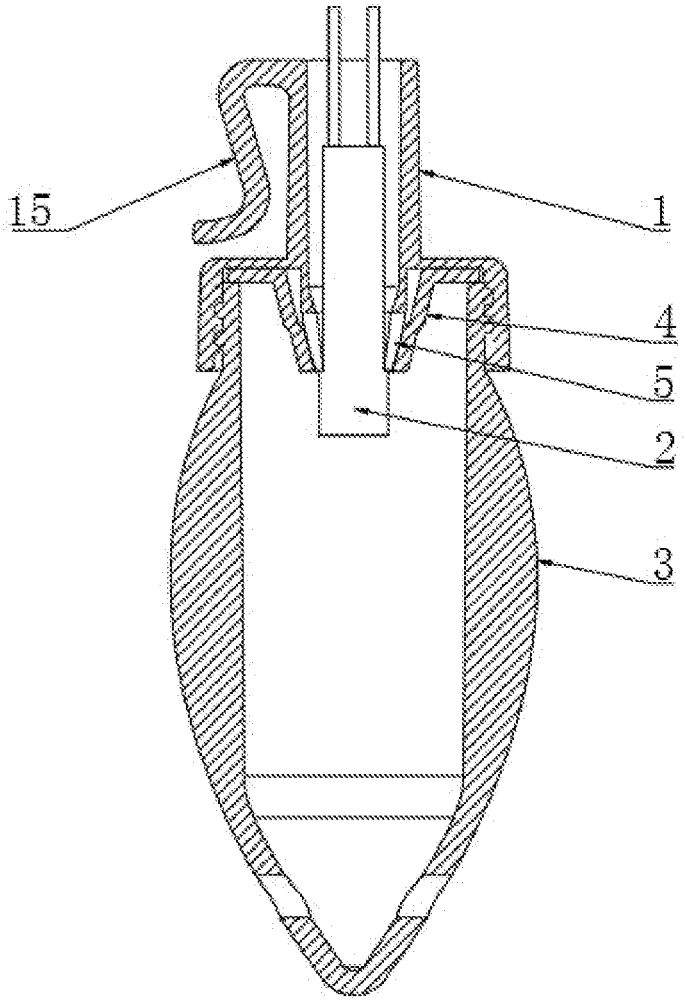
FIG. 3 is a schematic structural diagram of the present invention in a half-sectional view.

The present invention will be further described below by means of specific embodiments with reference to the accompanying drawings. With reference to FIGS. 1-3:

a Christmas lamp with a lamp core pull-out prevention structure includes a lamp holder 1, a lamp core 2 and a lamp shell 3. The lamp holder 1 is connected to the lamp shell 3, and the lamp core 2 passes through the lamp holder 1 and is located in the lamp shell 3. The Christmas lamp further includes:

a fixing ferrule 4.

The lamp holder 1 is internally provided with a resilient clamping sleeve 5 for radially clamping the lamp core 2, and the fixing ferrule 4 is provided over the resilient clamping sleeve 5.

When the lamp holder 1 is mounted and connected to the lamp shell 3, the fixing ferrule 4 is axially abutted between the lamp holder 1 and the lamp shell 3, and the fixing ferrule 4 radially locks the resilient clamping sleeve 5.

The resilient clamping sleeve 5 and the lamp holder 1 may be of an integrally formed structure. The resilient clamping sleeve 5 includes a plurality of clamping flaps arranged in an annular array at intervals, and the inner diameter of the resilient clamping sleeve 5 may gradually decrease from one end connected to the lamp holder 1 to the other end. When the head of the lamp core 2 passes through the lamp holder 1 and the resilient clamping sleeve 5, the resilient clamping sleeve 5 radially clamps the lamp core 2, and the end portion of the resilient clamping sleeve 5 axially abuts against the head of the lamp core 2, so as to provide the detachment prevention function. The fixing ferrule 4 is then mounted. After the fixing ferrule 4 is axially abutted, the fixing ferrule 4 will further radially clamp the resilient clamping sleeve 5. In this case, the end portion of the resilient clamping sleeve 5 cannot radially expand, so the resilient clamping sleeve 5 has good clamping stability, and the lamp holder cannot be axially pulled out, providing the detachment prevention function.

The lamp core 2 includes:

a luminous body 6 provided with two lead wires led out from the luminous body 6;

power lines 7, the power lines 7 being connected to the lead wires;

a core stem 8, wire grooves 9 being provided in a side wall of the core stem 8, and connected ends of the lead wires and the power lines 7 being embedded into the wire grooves 9; and a heat shrinkable tube 10, the heat shrinkable tube 10 being provided over an outer wall of the core stem 8.

An outer diameter of the luminous body 6 is greater than that of the core stem 8.

The luminous body 6 is a structure made of an LED lamp and glue directly injection-molded on the LED lamp. The core stem 8 provides shaping and separating protection functions for the connections between the lead wires and the power lines 7, avoiding the contact between the two lead wires. The heat shrinkable tube 10 further provides a wrapping protection function, which can not only play a fixing role, but also play a certain waterproof role. The length of the heat shrinkable tube 10 is longer than the core stem 8, so that one end of the heat shrinkable tube 10 can be wrapped around the tail of the luminous body 6, and the other, end of the heat shrinkable tube 10 can be wrapped around the power lines 7, providing better fixing and protecting functions. The tensile strength between the luminous body 6 and the power lines 7 can be improved, providing a breakage prevention function.

The lead wires and the power lines 7 are fixed by means of welding. For example, they may be fixed by means of soldering, which has high connection strength and good connection stability.

The fixing ferrule 4 includes:

a shrinkage section 11;

an expansion section 12; and a positioning ring 13.

The shrinkage section 11 is located at one end of the expansion section 12, and the positioning, ring 13 is located at the other end of the expansion section 12.

During installation, the fixing ferrule 4 is provided over the resilient clamping sleeve 5, the lamp shell 3 is then screwed, and the end portion of the lamp shell 3 axially abuts against the positioning ring 13. During the axial abutting process, the shrinkage section 11 radially abuts against the resilient clamping sleeve 5, such that the resilient clamping sleeve 5 is radially shrunk. In this case, at the position where the resilient clamping sleeve 5 radially clamps the core stem, an end face of the resilient clamping sleeve 5 axially abuts against the tail end of the luminous body 6, providing the axial pull-out prevention function.

The positioning ring 13 is provided with a notch 14, such that when the positioning ring 13 is mounted in the lamp holder 1, the arrangement of the notch 14 is convenient for providing a force receiving point and taking out the fixing ferrule 4.

The lamp holder 1 is in threaded connection with the lamp shell 3, facilitating locking, mounting and dismounting.

The lamp holder 1 is provided with a hanger 15, facilitating hanging during use.

A forming process for a Christmas lamp with a lamp core pull-out prevention structure includes:

a first step of preparing a lamp holder 1 and a lamp shell 3, the lamp holder 1 and the lamp shell 3 both may be injection molded;

a second step of assembling a lamp core 2; and a third step of assembling the Christmas lamp: passing the lamp core 2 through a resilient clamping sleeve 5 on the lamp holder 1, retaining an end portion of the resilient clamping sleeve 5 at the connection between a core stem 8 and a luminous body 6, then sleeving a fixing ferrule 4 over the resilient clamping sleeve 5, and finally screwing the lamp shell 3.

In the second step, the specific sub-steps of assembling the lamp core 2 include:

S1 fixing two lead wires of the luminous body 6 to power lines 7 by, means of welding;

S2. mounting a core stem 8 between the two lead wires, such that the connections between the two lead wires and the power lines 7 are embedded into wire grooves 9 of the core stem 8;

S3. sleeving a heat shrinkable tube 10 over the core stem 8, the length of the heat shrinkable tube 10 being greater than that of the core stem 8; and S4. blowing hot air over the heat shrinkable tube 10, such that the heat shrinkable tube 10 shrinks and clads the core stem 8, while one end of the heat shrinkable tube 10 partially clads the luminous body 6 and the other end of the heat shrinkable tube 10 partially clads the power lines 7.

The whole process of the specific sub-steps S1 to S4 of assembling the lamp core has realized automatic welding and production, greatly improving the production efficiency.

The forming method is simple, and the installation stability of the formed lamp core 2 is high, which can provide a good detachment prevention function.

The above embodiments are only the preferred embodiments of the present invention, and do not limit the scope of protection of the present invention accordingly. Therefore, any equivalent changes made according to the structure, shape and principle of the present invention should fall within the scope of protection of the present invention.

The invention claimed is:

1. A Christmas lamp with a lamp core pull-out prevention structure, which Christmas lamp comprises: a lamp holder (1), a lamp core (2) and a lamp shell (3), the lamp holder (1) being connected to the lamp shell (3), the lamp core (2) passing through the lamp holder (1) and being located in the lamp shell (3), the Christmas lamp further comprising:

a fixing ferrule (4), wherein the lamp holder (1) is internally provided with a resilient clamping sleeve (5) for radially clamping the lamp core (2), and the fixing ferrule (4) is provided over the resilient clamping sleeve (5); and when the lamp holder (1) is mounted and connected to the lamp shell (3), the fixing ferrule (4) is axially abutted between the lamp holder (1) and the lamp shell (3), and the fixing ferrule (4) radially locks the resilient clamping sleeve (5).

2. The Christmas lamp with a lamp core pull-out prevention structure of claim 1, wherein the lamp core (2) comprises:

a luminous body (6) provided with two lead wires led out from the luminous body (6);

power lines (7), the power lines (7) being connected to the lead wires;

a core stem (8), wire grooves (9) being provided in a side wall of the core stem (8), and connected ends of the lead wires and the power lines (7) being embedded into the wire grooves (9); and a heat shrinkable tube (10), the heat shrinkable tube (10) being provided over an outer wall of the core stem (8), wherein an outer diameter of the luminous body (6) is greater than an outer diameter of the core stem (8).

3. The Christmas lamp with a lamp core pull-out prevention structure of claim 2, wherein the lead wires are fixed to the power lines (7) by means of welding.

4. The Christmas lamp with a lamp core pull-out prevention structure of claim 1, wherein the fixing ferrule comprises:

a shrinkage section (11);

an expansion section (12); and a positioning ring (13), wherein the shrinkage section (11) is located at one end of the expansion section (12), and the positioning ring (13) is located at the other end of the expansion section (12).

5. The Christmas lamp with a lamp core pull-out prevention structure of claim 4, wherein the positioning ring (13) is provided with a notch (14).

6. The Christmas lamp with a lamp core pull-out prevention structure of claim 1, wherein the lamp holder (1) is in threaded connection with the lamp shell (3).

7. The Christmas lamp with a lamp core pull-out prevention structure of claim 1, wherein the lamp holder (1) is provided with a hanger (15).

8. A forming process applicable to the Christmas lamp with a lamp core pull-out prevention structure of claim 2, comprising:

a first step of preparing a lamp holder (1) and a lamp shell (3);

a second step of assembling a lamp core (2); and a third step of assembling the Christmas lamp: passing the lamp core (2) through a resilient clamping sleeve (5) on the lamp holder (1), retaining an end portion of the resilient clamping sleeve (5) at the connection between a core stem (8) and a luminous body (6), then sleeving a fixing ferrule (4) over the resilient clamping sleeve (5), and finally screwing the lamp shell (3), wherein in the second step, the specific sub-steps of assembling the lamp core (2) comprise:

S1. fixing two lead wires of the luminous body (6) to power lines (7) by means of welding;

S2. mounting a core stem (8) between the two lead wires, such that the connections between the W/O lead wires and the power lines (7) are embedded into wire grooves (9) of the core stem (8);

S3. sleeving a heat shrinkable tube (10) over the core stem (8), the length of the heat shrinkable tube (10) being greater than that of the core stem (8); and S4. blowing hot air over the heat shrinkable tube (10), such that the heat shrinkable tube (10) shrinks and clads the core stein (8), while one end of the heat shrinkable tube (10) partially clads the luminous body (6) and the other end of the heat shrinkable tube (10) partially clads the power lines (7).

* * * * *